US011226111B2

(12) United States Patent
Komatsu

(10) Patent No.: US 11,226,111 B2
(45) Date of Patent: Jan. 18, 2022

(54) INDOOR UNIT

(71) Applicant: DAIKIN INDUSTRIES, LTD., Osaka (JP)

(72) Inventor: Akira Komatsu, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 63 days.

(21) Appl. No.: 16/330,189

(22) PCT Filed: Sep. 4, 2017

(86) PCT No.: PCT/JP2017/031818
§ 371 (c)(1),
(2) Date: Mar. 4, 2019

(87) PCT Pub. No.: WO2018/043745
PCT Pub. Date: Mar. 8, 2018

(65) Prior Publication Data

US 2019/0186759 A1 Jun. 20, 2019

(30) Foreign Application Priority Data

Sep. 5, 2016 (JP) ..... JP2016-172473

(51) Int. Cl.
*F24F 1/0011* (2019.01)
*F24F 1/06* (2011.01)
(Continued)

(52) U.S. Cl.
CPC ..... *F24F 1/0011* (2013.01); *F24F 1/0018* (2013.01); *F24F 1/0059* (2013.01); *F24F 1/06* (2013.01)

(58) Field of Classification Search
CPC .. F25B 2700/21175; F25B 2700/21163; F24F 1/0018; F24F 1/0014; F24F 1/0011; F24F 1/06
See application file for complete search history.

(56) References Cited

U.S. PATENT DOCUMENTS

2017/0030594 A1* 2/2017 Robinson ..... F24D 17/02
2017/0292732 A1 10/2017 Kojima et al.

FOREIGN PATENT DOCUMENTS

GB 2260830 A 4/1993
JP 3-164646 A 7/1991
(Continued)

OTHER PUBLICATIONS

Translation of JPH03164646A (Year: 1991).*
(Continued)

*Primary Examiner* — Schyler S Sanks
(74) *Attorney, Agent, or Firm* — Birch, Stewart, Kolasch & Birch, LLP

(57) ABSTRACT

Disclosed herein is an indoor unit which can easily create a plurality of areas having different temperatures in a single indoor space, with even a single indoor unit. An indoor space is divided into a plurality of areas. An airflow direction adjusting flap provided at a blow-out opening is capable guiding blown air to each of the areas. An amount of heat to be processed for each of the plurality of areas by the air blown out of the blow-out opening is adjusted so that temperatures of at least two of the areas are different from each other.

4 Claims, 12 Drawing Sheets

(51) Int. Cl.
*F24F 1/0059* (2019.01)
*F24F 1/0018* (2019.01)

(56) References Cited

FOREIGN PATENT DOCUMENTS

| | | | | |
|---|---|---|---|---|
| JP | H03164646 | A | * | 7/1991 |
| JP | 2005-16885 | A | | 1/2005 |
| JP | 2005016885 | A | * | 1/2005 |
| JP | 2009-150580 | A | | 7/2009 |
| JP | 2009-299965 | A | | 12/2009 |
| JP | 2010-261643 | A | | 11/2010 |
| JP | 2012184868 | A | * | 9/2012 |
| JP | 2015-68614 | A | | 4/2015 |
| JP | 2016-1077 | A | | 1/2016 |
| JP | 2016001077 | A | * | 1/2016 |
| JP | 2016-38159 | A | | 3/2016 |
| WO | WO 2010/125804 | A1 | | 11/2010 |
| WO | WO 2016/051637 | A1 | | 4/2016 |

OTHER PUBLICATIONS

Translation of JP2016001077A (Year: 2016).*
JP2005016885A Translation (Year: 2005).*
JP2012184868A Translation (Year: 2012).*
International Search Report (PCT/ISA/237) issued in PCT/JP2017/031818, dated Oct. 31, 2017.

* cited by examiner

| | AREA A | AREA B |
|---|---|---|
| 〈COOLING OPERATION〉 EVAPORATION TEMPERATURE | HIGHER | LOWER |
| 〈HEATING OPERATION〉 CONDENSATION TEMPERATURE | LOWER | HIGHER |

INDOOR UNIT

TECHNICAL FIELD

The present invention relates to an indoor unit of an air conditioner.

BACKGROUND ART

Airflow is usually controlled in an indoor space so that a temperature of the indoor space be uniform.

In some cases, however, it is desired to create a plurality of areas having different temperatures in a single indoor space in order to use the single indoor space for various purposes or to meet the preferences in temperature of individual users. The air-conditioning system disclosed in Patent Document 1, for example, has been known as a technique relating to such cases.

CITATION LIST

Patent Document

Patent Document 1: Japanese Unexamined Patent Publication No. 2009-299965

SUMMARY OF THE INVENTION

Technical Problem

The air-conditioning system of Patent Document 1 utilizes a plurality of air conditioners to cause temperatures of areas in a single indoor space to differ from each other, which leads to the relatively high cost of the air-conditioning system. Patent Document 1 also discloses operating the plurality of air conditioners in synchronization with each other so that the areas be divided from each other by airflow. The operation of the air-conditioning system is therefore complicated, and it is far from easy to construct such a system.

In view of the foregoing background, the present invention intends to easily create a plurality of areas having different temperatures in a single indoor space even in a condition in which an air conditioner includes only one indoor unit.

Solution to the Problem

A first aspect of the present disclosure is directed to an indoor unit (10) of an air conditioner, the indoor unit (10) blowing air to an indoor space (500), the indoor unit (10) including: an indoor casing (20) provided with a blow-out opening (24*a* to 24*d*); a storage unit (91) which stores division information (91*a*) about division of the indoor space (500) into a plurality of areas (500A, 500B); an airflow direction adjusting flap (51) provided at the blow-out opening (24*a* to 24*d*) and capable of guiding air blown out of the blow-out opening (24*a* to 24*d*) to each of the areas (500A, 500B) in the division information (91*a*); and an adjuster (92) which adjusts an amount of heat to be processed for each of the plurality of areas (500A, 500B) by the air blown out of the blow-out opening (24*a* to 24*b*) so that temperatures in at least two of the areas (500A, 500B) are different from each other.

According to the first aspect, air blown from a single indoor unit (10) is supplied to each of at least two areas (500A, 500B) of the indoor space (500). In particular, the amount of heat to be processed by the blown air for each of the areas (500A, 500B) is adjusted so that the temperatures of the respective areas (500A, 500B) differ from each other. For example, a method for adjusting the amount of heat to be processed includes: adjusting a period of time in which the airflow direction adjusting flap (51) guides the blown air in a predetermined direction so that the integrated volume of air reaching the respective areas (500A, 500B) per predetermined time period may differ between the areas (500A, 500B); and causing temperatures of the air itself blown into the respective areas (500A, 500B) to differ from each other. This configuration makes it possible to easily create, with even a single indoor unit (10), a plurality of areas (500A, 500B) having different temperatures in a single indoor space (500).

A second aspect of the present disclosure is an embodiment of the first aspect. In the second aspect, the indoor unit (10) further includes a temperature sensor (81*a*, 81*b*) which detects a temperature of at least one of the plurality of areas (500A, 500B), wherein based on the detected temperature of the at least one area (500A, 500B), the adjuster (92) further adjusts the amount of heat to be processed for the at least one area (500A, 500B).

Thus, the area (500A, 500B), for which the amount of heat to be processed is adjusted based on the detection result of the temperature sensor (81*a*, 81*b*), has a temperature different from the temperature of the other area with more reliability.

A third aspect of the present disclosure is an embodiment of the first or second aspect. In the third aspect, the adjuster (92) adjusts the amount of heat to be processed for each of the at least two areas (500A, 500B) by causing an integrated volume of blown air to be supplied to each of the two areas (500A, 500B) per predetermined time period to differ between the areas (500A, 500B).

This configuration allows the target areas (500A, 500B), in which the temperatures are intended to differ between the areas, to have different temperatures at least after the lapse of a predetermined time period with reliability.

A fourth aspect of the present disclosure is an embodiment of the third aspect. In the fourth aspect, the blow-out opening (24*a* to 24*d*) is provided with an airflow inhibition mechanism (50) which inhibits an airflow of the air blown out of the blow-out opening (24*a* to 24*d*), and the adjuster (92) causes the integrated volume per the predetermined time period to differ between the areas (500A, 500B) by adjusting a length of time in which the airflow inhibition mechanism (50) inhibits the airflow.

According to the fourth aspect, volume of the airflow reaching the respective areas (500A, 500B) is adjusted by adjusting a length of time in which the airflow inhibition mechanism (50) inhibits the airflow. This configuration allows the target areas (500A, 500B), in which the temperatures are intended to differ between the areas, to have different temperatures at least after the lapse of a predetermined time period with more reliability.

A fifth aspect of the present disclosure is an embodiment of the fourth aspect. In the fifth aspect, the airflow direction adjusting flap (51) is capable of moving to a position at which the airflow direction adjusting flap (51) inhibits the airflow blown out of the blow-out opening (24*a* to 24*d*), and serves as the airflow inhibition mechanism (50).

Such features allow each area (500A, 500B) to have a different temperature without another airflow inhibition mechanism (50) in addition to the airflow direction adjusting flap (51).

A sixth aspect of the present disclosure is an embodiment of any one of the third to fifth aspects. In the sixth aspect, the indoor unit further includes an indoor fan (31) creating the airflow of the air blown out of the blow-out opening (24*a* to 24*d*) of the indoor casing (20), wherein the adjuster (92) causes the integrated volume of air per the predetermined time period to differ between the areas (500A, 500B) by adjusting a rotational speed of the indoor fan (31).

According to the sixth aspect, volume of the airflow reaching the respective areas (500A, 500B) is adjusted by adjusting the rotational speed of the indoor fan (31). This configuration allows the target areas (500A, 500B), in which the temperatures are intended to differ between the areas, to have different temperatures at least after the lapse of a predetermined time period with more reliability.

A seventh aspect of the present disclosure is an embodiment of any one of the first to sixth aspects. In the seventh aspect, the indoor unit further includes an indoor heat exchanger (32) which functions as an evaporator of a refrigerant to cool air before blown out of the blow-out opening (24*a* to 24*d*), wherein the adjuster (92) adjusts the amount of heat to be processed for each of the at least two areas (500A, 500B) by causing an evaporation temperature of the refrigerant in the indoor heat exchanger (32) to differ between the at least two areas (500A, 500B).

The above-disclosed configuration achieves a more distinct difference in temperatures of the air that has reached the respective areas (500A, 500B) in the cooling operation, which reliably creates a situation in which the temperatures of the respective areas (500A, 500B) are different from each other.

An eighth aspect of the present disclosure is an embodiment of the seventh aspect. In the eighth aspect, the adjuster (92) sets a different target value of the evaporation temperature for each of the at least two areas (500A, 500B).

The different target values of the evaporation temperatures for the respective areas (500A, 500B) contribute to achieving a more distinct difference in the temperatures of the air that has reached the respective areas (500A, 500B) in a cooling operation.

A ninth aspect of the present disclosure is an embodiment of any one of the first to sixth aspects. In the ninth aspect, the indoor unit further includes an indoor heat exchanger (32) which functions as a radiator of a refrigerant to heat air before blown out of the blow-out opening (24*a* to 24*d*), wherein the adjuster (92) adjusts the amount of heat to be processed for each of the at least two areas (500A, 500B) by causing a condensation temperature of the refrigerant in the indoor heat exchanger (32) to differ between the at least two areas (500A, 500B).

The above-disclosed configuration achieves a more distinct difference in temperatures of the air that has reached the respective areas (500A, 500B) in the heating operation, which reliably creates a situation in which the temperatures of the respective areas (500A, 500B) are different from each other.

A tenth aspect of the present disclosure is an embodiment of the ninth aspect. In the tenth aspect, the adjuster (92) sets a different target value of the condensation temperature for each of the at least two areas (500A, 500B).

The different target values of the condensation temperatures for the respective areas (500A, 500B) contribute to achieving a more distinct difference in the temperatures of the air that has reached the respective areas (500A, 500B) in a heating operation.

Advantages of the Invention

The aspects of the present disclosure make it possible to easily create, with even a single indoor unit (10), a plurality of areas (500A, 500B) having different temperatures in a single indoor space (500).

DESCRIPTION OF EMBODIMENTS

Embodiments of the present invention will now be described in detail with reference to the drawings. The following embodiments are merely exemplary ones in nature, and are not intended to limit the scope, application, or uses of the invention.

First Embodiment

<General Description>

Figure 1:
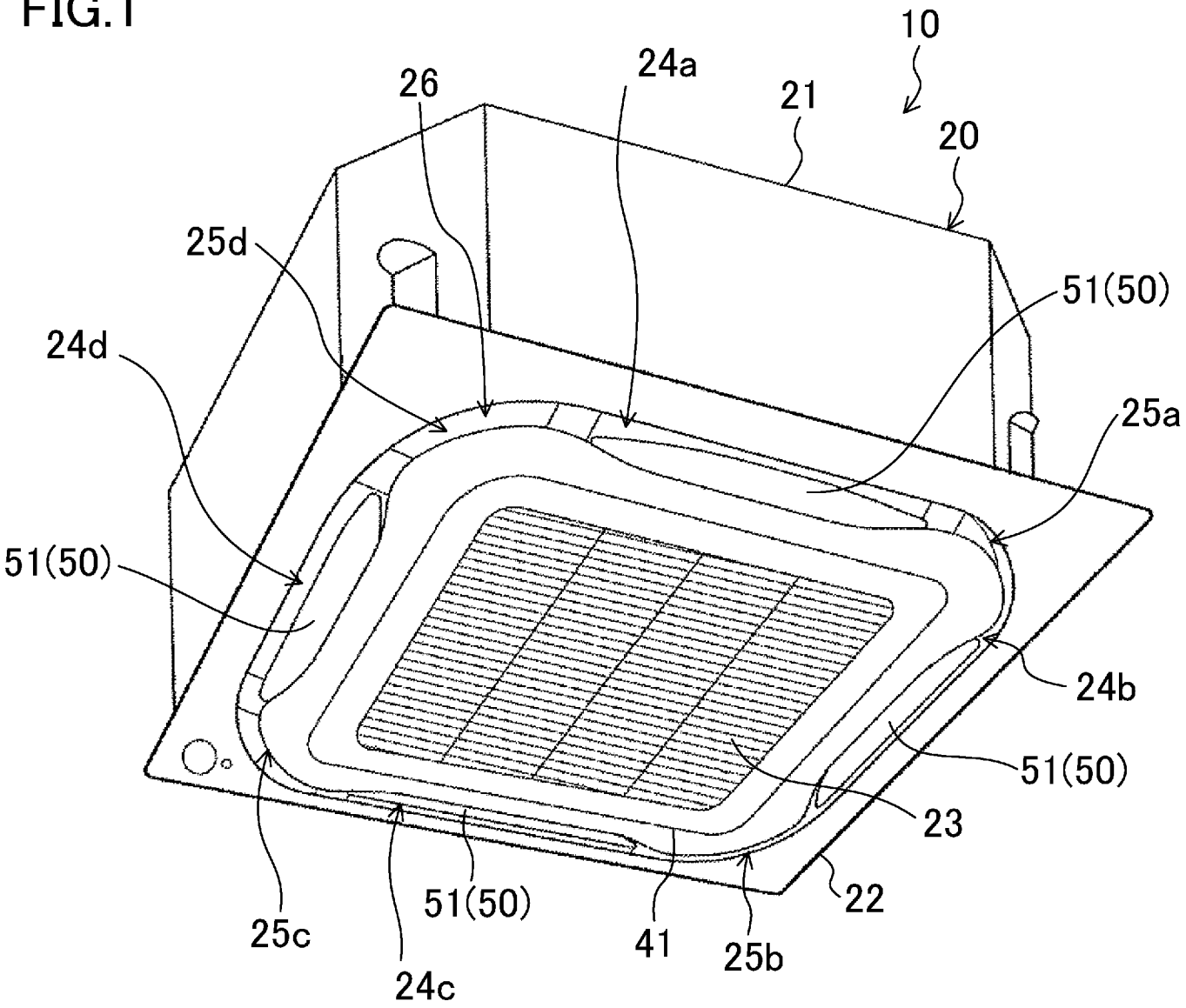
FIG. 1 is a diagram illustrating a perspective view of an indoor unit of a first embodiment viewed obliquely from below.

As illustrated in FIG. 1, an indoor unit (10) of a first embodiment is configured as a ceiling embedded indoor unit. The indoor unit (10) and an outdoor unit (not shown)

constitute an air conditioner. In the air conditioner, the indoor unit (10) and the outdoor unit are connected to each other by a connection pipe to form a refrigerant circuit in which a refrigerant circulates to conduct a refrigeration cycle.

An indoor space (500) in which the indoor unit (10) is installed will be described below. The indoor space (500) is a single living room or room. The indoor unit (10) is embedded in a ceiling at the center of the indoor space (500).

Figure 2:
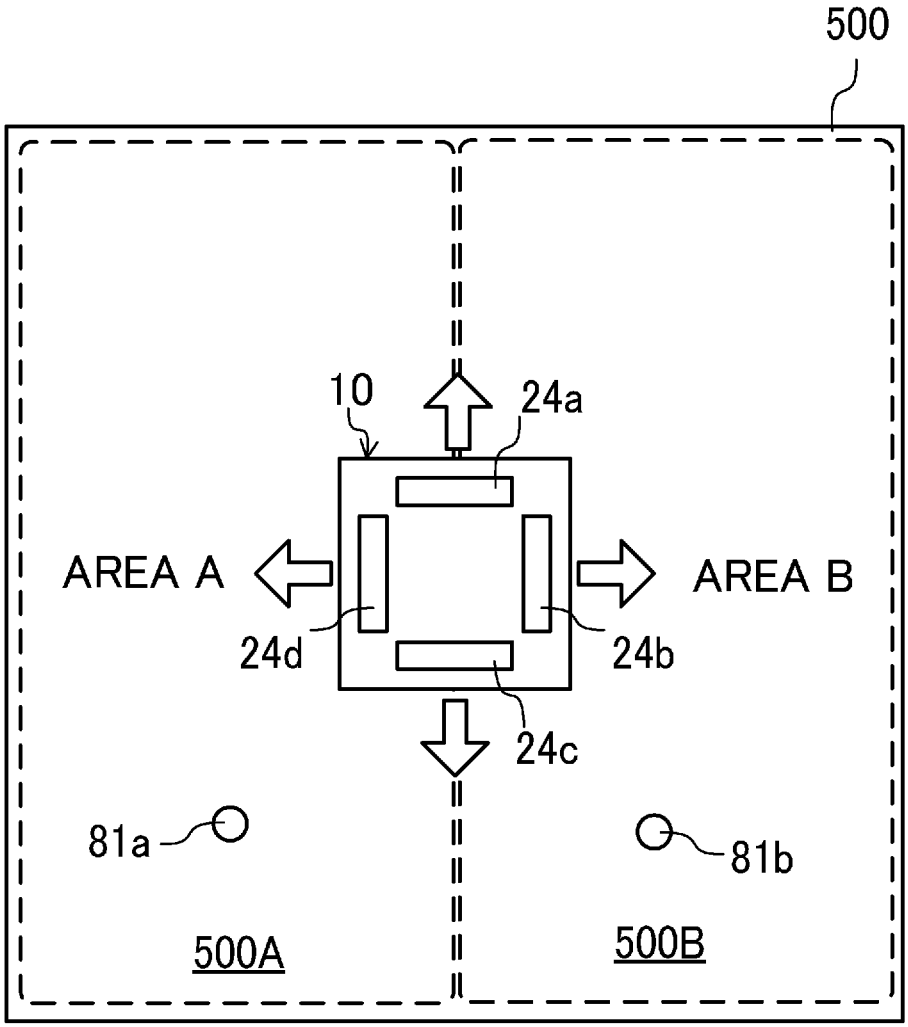
FIG. 2 is a plan view of an indoor space in which the indoor unit is installed.

The indoor space (500) is divided into a plurality of regions in plan view. As illustrated in FIG. 2, the first embodiment describes, as an example, a case in which the indoor space (500) is divided into two areas in plan view, that is, a left area (500A) and a right area (500B) in relation to the indoor unit (10). The left area (500A) and the right area (500B) are substantially equal in area size.

Each area (500A, 500B) is provided with one temperature sensor (81*a*, 81*b*). The temperature sensor (81*a*, 81*b*) is placed, for example, on a desk in the area (500A, 500B), and detects the temperature of the area (500A, 500B) where the temperature sensor (81*a*, 81*b*) is provided.

Hereinafter, information about the division of the indoor space (500) into the areas (500A, 500B) as described above will be referred to as "division information." The "division information" may be set in advance before shipment of the air conditioner, or may be input and set by a user via a remote controller or a centralized management apparatus connected to the indoor unit (10) after the air conditioner is installed.

In a preferred embodiment, one of the areas (500A, 500B) may be set to be a high-priority area and the other to be a low-priority area by an installation worker or a maintenance worker of the indoor unit (10) via, for example, a not-shown remote controller or DIP switch.

Note that the number of divided areas of the indoor space (500) is not limited to two. The areas (500A, 500B) do not have to be equal in area size.

<Configurations>

As illustrated in FIGS. 1 and 3 to 6, the indoor unit (10) has a casing (20) (which corresponds to an indoor casing), an indoor fan (31), an indoor heat exchanger (32), a drain pan (33), a bell mouth (36), an airflow direction adjusting flap (51), and an indoor control unit (90).

Casing

The casing (20) is comprised of a casing body (21) and a decorative panel (22). The casing (20) houses the indoor fan (31), the indoor heat exchanger (32), the drain pan (33), and the bell mouth (36).

Figure 3:
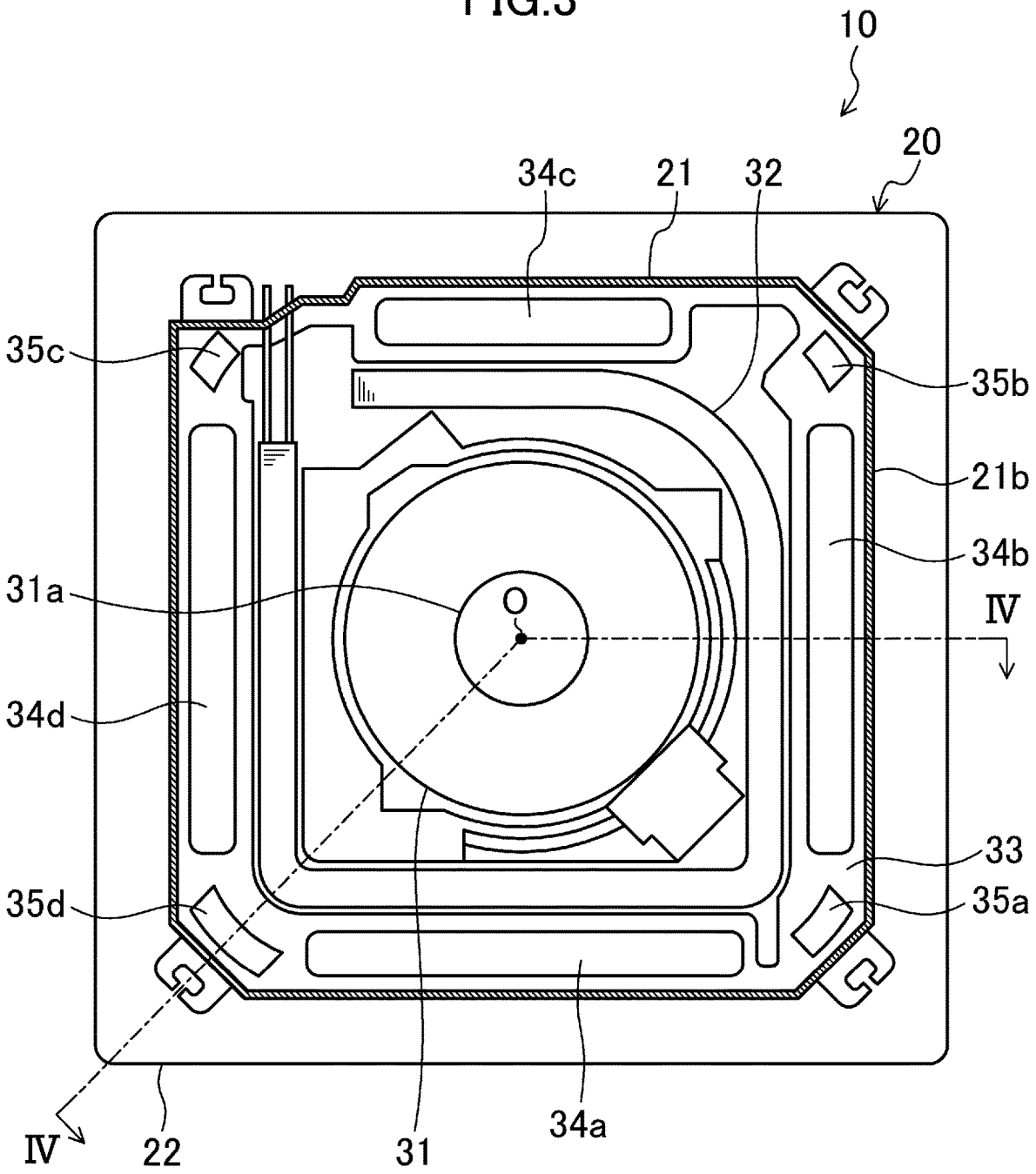
FIG. 3 is a diagram generally illustrating a plan view of the indoor unit from which a top panel of a casing body is omitted.

As illustrated in FIG. 3, the casing body (21) is mounted by being inserted in an opening in the ceiling (501) of the indoor space (500). The casing body (21) has a generally rectangular parallelepiped box-like shape with its lower end open. The casing body (21) has approximately a flat plate-shaped top panel (21*a*) and a side plate (21*b*) projecting down from a peripheral portion of the top panel (21*a*).

Indoor Fan

Figure 4:
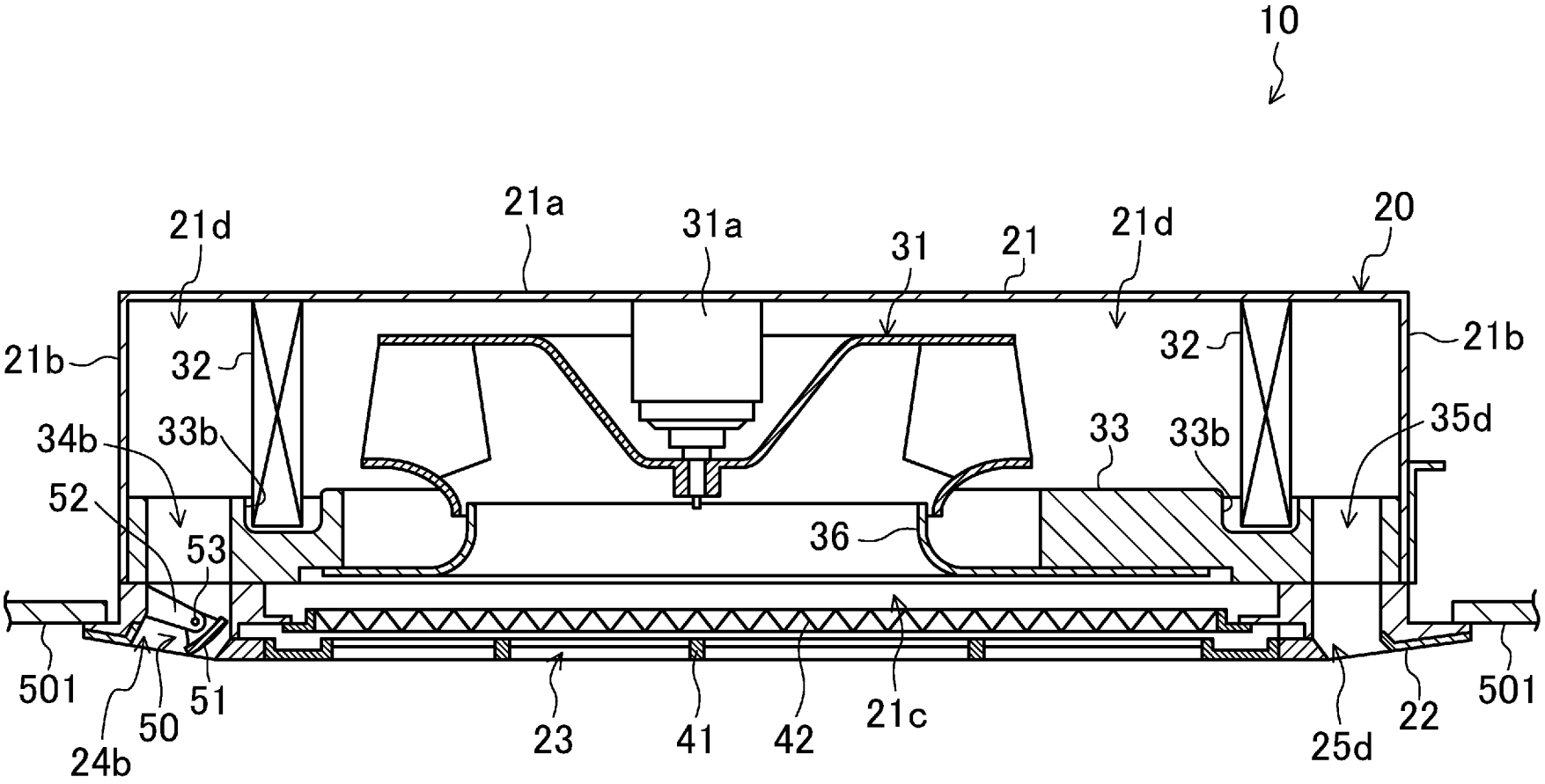
FIG. 4 is a diagram generally illustrating a cross-sectional view of the indoor unit taken along the line IV-O-IV shown in FIG. 3.

As illustrated in FIG. 4, the indoor fan (31) is a centrifugal blower which draws air from below and expels the air radially outward. The indoor fan (31) is arranged at the center in the casing body (21). The indoor fan (31) is driven by an indoor fan motor (31*a*). The indoor fan motor (31*a*) is fixed to a central portion of the top panel (21*a*).

Bell Mouth

The bell mouth (36) is provided below the indoor fan (31), and guides the air which has flowed in the casing (20) to the indoor fan (31). The bell mouth (36) and the drain pan (33) divide the internal space of the casing (20) into a primary space (21*c*) located on a suction side of the indoor fan (31) and a secondary space (21*d*) located on an air-blowing side of the indoor fan (31).

Indoor Heat Exchanger

The indoor heat exchanger (32) is a so-called cross-fin-type fin-and-tube heat exchanger. As illustrated in FIG. 3, the indoor heat exchanger (32) has a hollow square shape when viewed in plan, and surrounds the indoor fan (31). That is, the indoor heat exchanger (32) is arranged in the secondary space (21*d*). The indoor heat exchanger (32) allows the air passing therethrough from the inside to the outside to exchange heat with the refrigerant in the refrigerant circuit. In other words, the indoor heat exchanger (32) allows heat exchange of air before supplied from a main blow-out opening (24*a* to 24*d*) (corresponding to a blow-out opening) and an auxiliary blow-out opening (25*a* to 25*d*) illustrated in FIG. 5.

<Drain Pan>

The drain pan (33) is a member made of extruded polystyrene foam. As illustrated in FIG. 4, the drain pan (33) is arranged to block a lower end of the casing body (21). The drain pan (33) has an upper surface provided with a water receiving groove (33*b*) extending along a lower end of the indoor heat exchanger (32). A lower end portion of the indoor heat exchanger (32) is inserted in the water receiving groove (33*b*). The water receiving groove (33*b*) receives drain water generated in the indoor heat exchanger (32).

As illustrated in FIG. 3, the drain pan (33) is provided with four main blow-out paths (34*a* to 34*d*) and four auxiliary blow-out paths (35*a* to 35*d*). The main blow-out paths (34*a* to 34*d*) and the auxiliary blow-out paths (35*a* to 35*d*) are paths in which the air that has passed through the indoor heat exchanger (32) flows. The main blow-out paths (34*a* to 34*d*) and the auxiliary blow-out paths (35*a* to 35*d*) pass through the drain pan (33) in a vertical direction. The main blow-out paths (34*a* to 34*d*) are through holes each having an elongated rectangular cross section. The main blow-out paths (34*a* to 34*d*) are disposed along the four sides of the casing body (21). Each side of the casing body (21) is provided with one main blow-out path. The auxiliary blow-out paths (35*a* to 35*d*) are through holes each having a slightly curved rectangular cross section. The auxiliary blow-out paths (35*a* to 35*d*) are disposed at the four corners of the casing body (21). Each corner of the casing body (21) is provided with one blow-out path. That is, the main blow-out paths (34*a* to 34*d*) and the auxiliary blow-out paths (35*a* to 35*d*) are alternately arranged along the peripheral edge of the drain pan (33).

Decorative Panel

The decorative panel (22) is a resinous member formed into a thick rectangular plate-like shape. As illustrated in FIGS. 3 and 4, a lower portion of the decorative panel (22) is in a square shape slightly larger than the top panel (21*a*) of the casing body (21). The decorative panel (22) is arranged to cover the lower end of the casing body (21). The lower surface of the decorative panel (22) serves as a lower surface of the casing (20) and is exposed to the indoor space (500).

Figure 5:
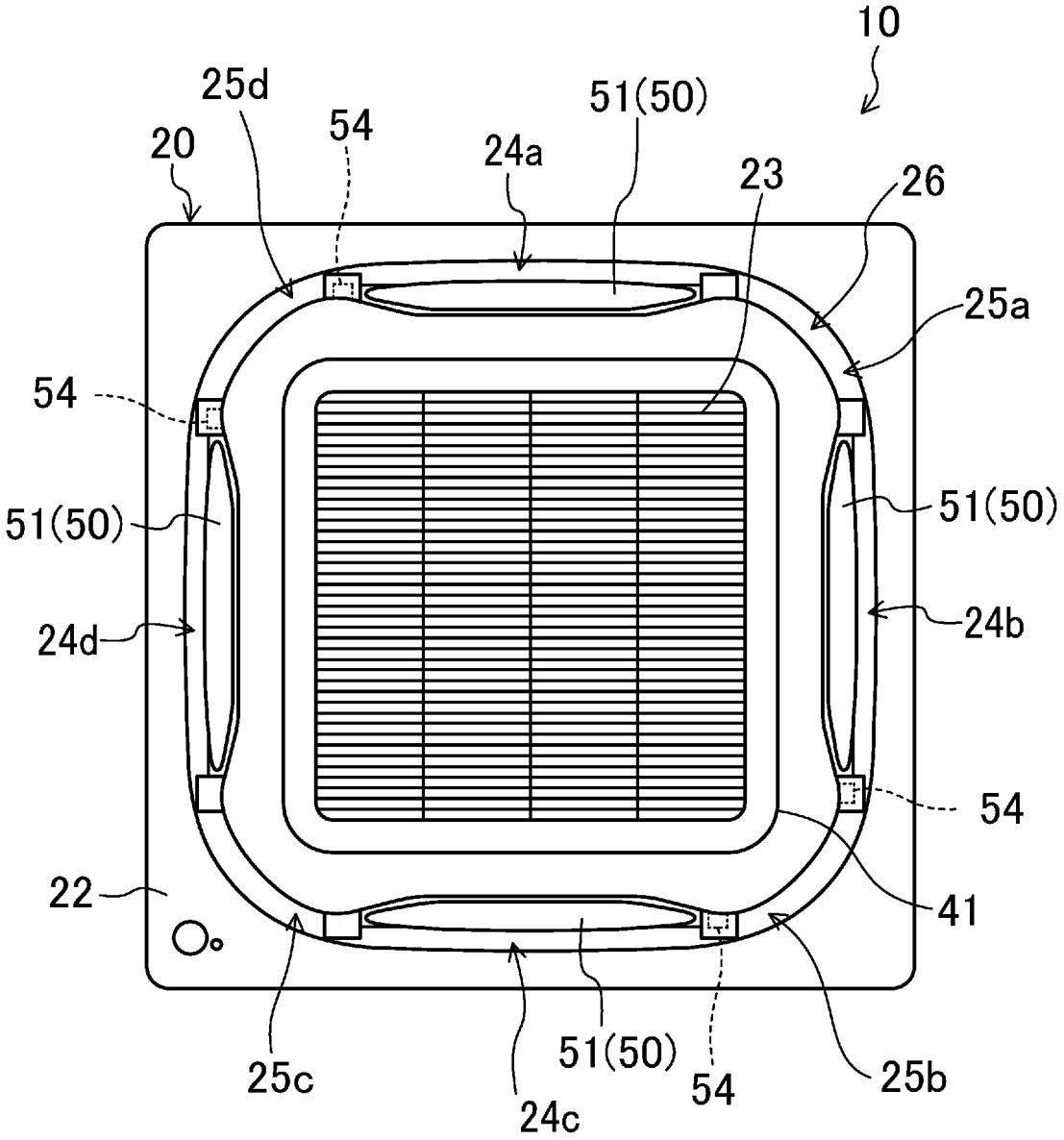
FIG. 5 is a diagram generally illustrating a bottom view of the indoor unit.

As illustrated in FIG. 5, the decorative panel (22) is provided with a square inlet (23) at a central section. As illustrated in FIG. 4, the inlet (23) passes through the decorative panel (22) in the vertical direction and communicates with the primary space (21*c*) in the casing (20). The air drawn into the casing (20) flows into the primary space (21*c*) through the inlet (23). The inlet (23) is provided with a grid-like intake grille (41). An intake filter (42) is arranged above the intake grille (41).

As illustrated in FIG. 5, the decorative panel (22) includes a substantially rectangular annular blow-out opening (26) surrounding the inlet (23). The blow-out opening (26) is divided into four main blow-out openings (24*a* to 24*d*) and four auxiliary blow-out openings (25*a* to 25*d*).

Each of the main blow-out openings (24*a* to 24*d*) has an elongated shape which corresponds to the cross sectional shape of each of the main blow-out paths (34*a* to 34*d*). The main blow-out openings (24*a* to 24*d*) are disposed along the four sides of the decorative panel (22). Each side of the decorative panel (22) is provided with one main blow-out opening.

The main blow-out openings (24*a* to 24*d*) of the decorative panel (22) correspond to the main blow-out paths (34*a* to 34*d*) of the drain pan (33) on a one-on-one basis. Each of the main blow-out openings (24*a* to 24*d*) communicates with a corresponding one of the main blow-out paths (34*a* to 34*d*). That is, the first main blow-out opening (24*a*) communicates with the first main blow-out path (34*a*). The second main blow-out opening (24*b*) communicates with the second main blow-out path (34*b*). The third main blow-out opening (24*c*) communicates with the third main blow-out path (34*c*). The fourth main blow-out opening (24*d*) communicates with the fourth main blow-out path (34*d*).

Each of the auxiliary blow-out openings (25*a* to 25*d*) is in the shape of a quarter of a circle. The auxiliary blow-out openings (25*a* to 25*d*) are disposed at the four corners of the decorative panel (22). Each corner of the decorative panel (22) is provided with one auxiliary blow-out opening. The auxiliary blow-out openings (25*a* to 25*d*) of the decorative panel (22) correspond to the auxiliary blow-out paths (35*a* to 35*d*) of the drain pan (33) on a one-on-one basis. Each of the auxiliary blow-out openings (25*a* to 25*d*) communicates with a corresponding one of the auxiliary blow-out paths (35*a* to 35*d*). That is, the first auxiliary blow-out opening (25*a*) communicates with the first auxiliary blow-out path (35*a*). The second auxiliary blow-out opening (25*b*) communicates with the second auxiliary blow-out path (35*b*). The third auxiliary blow-out opening (25*c*) communicates with the third auxiliary blow-out path (35*c*). The fourth blow-out opening (25*d*) communicates with the fourth auxiliary blow-out path (35*d*).

Airflow Direction Adjusting Flap

As illustrated in FIG. 5, each of the main blow-out openings (24*a* to 24*d*) is provided with an airflow direction adjusting flap (51). The airflow direction adjusting flap (51) is a member which adjusts the direction of blown air (that is, the direction of air blown from the main blow-out openings (24*a* to 24*d*)). The airflow direction adjusting flap (51) can change the direction of blown air upward and downward. The blown air reaches each area (500A, 500B) soon. The airflow direction adjusting flap (51) can thus be considered as a member capable of guiding the air blown from the main blow-out openings (24*a* to 24*d*) to the respective areas (500 A, 500B).

The airflow direction adjusting flap (51) has an elongated plate-like shape extending from one longitudinal end to the other longitudinal end of the main blow-out opening (24*a* to 24*d*) formed in the decorative panel (22). As illustrated in FIG. 4, the airflow direction adjusting flap (51) is supported by a support member (52) so as to be rotatable about a central shaft (53) of the airflow direction adjusting flap (51) extending in the longitudinal direction thereof. The airflow direction adjusting flap (51) is curved such that its lateral cross section (a cross section taken in a direction orthogonal to the longitudinal direction) forms a convex shape in a direction away from the central shaft (53) of swing movement.

As illustrated in FIG. 5, a drive motor (54) is coupled to each airflow direction adjusting flap (51). The airflow direction adjusting flap (51) is driven by the drive motor (54), and rotates about the central shaft (53) within a predetermined angle range. Although described in detail later, the airflow direction adjusting flap (51) can move to an airflow blocking position where the airflow direction adjusting flap (51) interrupts the flow of air passing through the main blow-out opening (24*a* to 24*d*). The airflow direction adjusting flap (51) also functions as an airflow inhibition mechanism (50) which inhibits the air blown from the main blow-out opening (24*a* to 24*d*).

Indoor Control Unit

Figure 6:
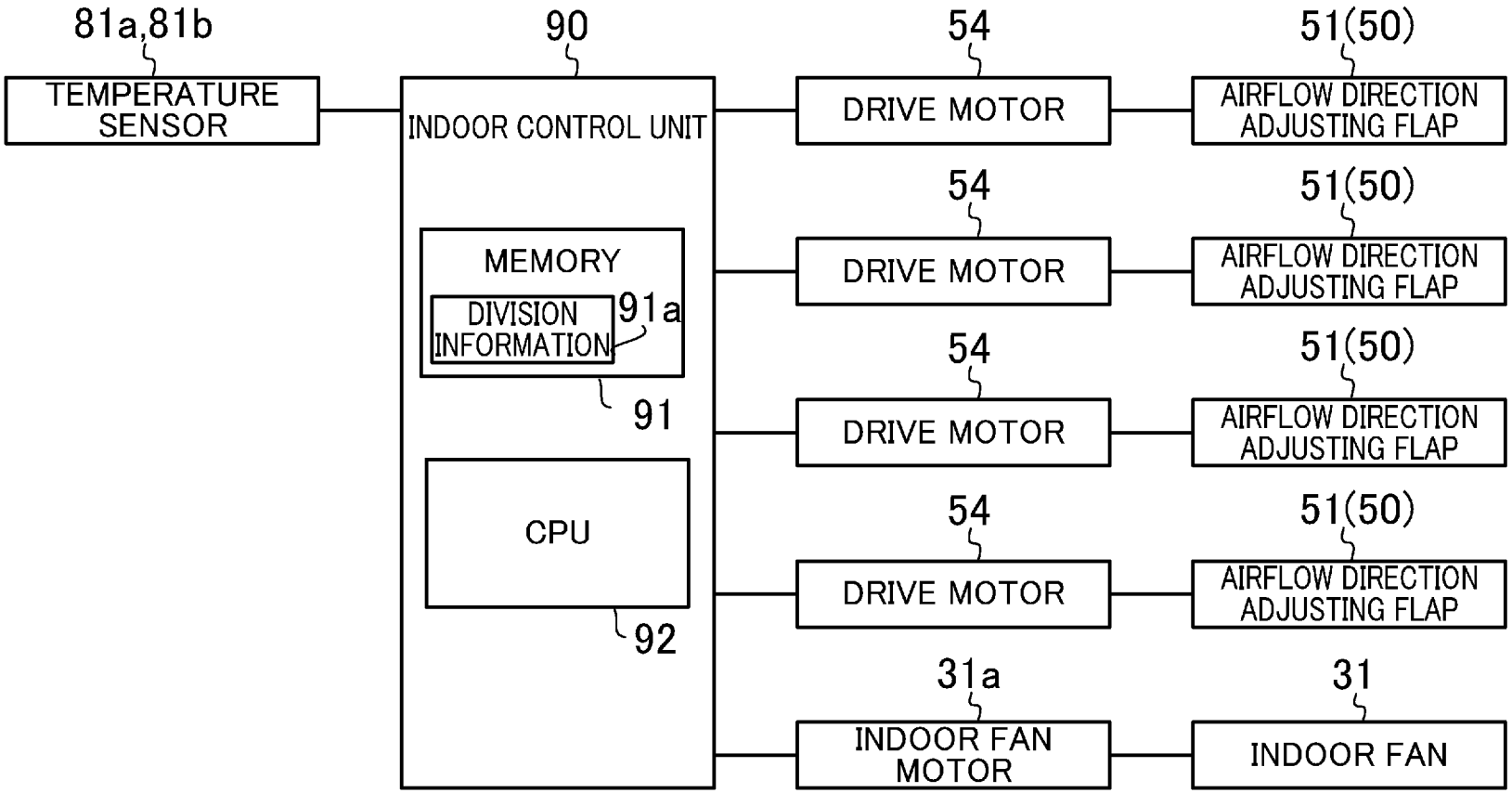
FIG. 6 is a block diagram schematically illustrating an indoor control unit and devices connected to the indoor control unit.

The indoor control unit (90) has a memory (91) and a central processing unit (CPU) (92) (which corresponds to an adjuster), and controls the operation of the indoor unit (10). As illustrated in FIG. 6, the indoor control unit (90) is connected to the temperature sensor (81*a*, 81*b*) of each area (500A, 500B) so as to communicate with the temperature sensor (81*a*, 81*b*). The indoor control unit (90) is also electrically connected to each of the drive motors (54) and the indoor fan motor (31*a*) or the like. With the CPU (92) reading and executing a program stored in the memory (91), the indoor control unit (90) controls a rotational speed of the indoor fan (31) and a direction of the air blown from each of the main blow-out openings (24*a* to 24*d*).

The memory (91) according to the first embodiment stores the above-described division information (91*a*). In storing the division information (91*a*), the memory (91) may store target temperatures of the respective areas (500A, 500 B). The target temperature of the area (500 A) and the target temperature of the area (500B) are different from each other.

In particular, in a condition in which a zoning mode is selected, the CPU (92) controls the positions of the airflow direction adjusting flaps (51) independently of one another to adjust an amount of heat to be processed, for each of the areas (500A, 500B), by the air blown from the main blow-out openings (24*a* to 24*d*) so that the temperatures in the areas (500A, 500B) differ from each other. In the first embodiment, the CPU (92) causes each airflow direction adjusting flap (51) to execute an airflow rotation operation in order to achieve the above control and adjustment in the condition in which the zoning mode is selected.

The CPU (92) further adjusts, in the airflow rotation operation, the amount of heat to be processed for each area (500A, 500B), based on the detection result of the temperature sensors (81*a*, 81*b*) for the respective areas (500A, 500B). In other words, the CPU (92) performs feedback control on the amount of heat to be processed for each of the areas (500A, 500B), based on the detection result of the temperature sensors (81*a*, 81*b*).

Note that in a condition in which a standard blow-out mode is selected, the indoor unit (10) executes only an operation in which air is blown from all of the main blow-out openings (24*a* to 24*d*).

The position taken by each airflow direction adjusting flap (51) and the airflow rotation operation in the zoning mode will be described later.

Note that the air conditioner is capable of performing a heating operation or a cooling operation in both of the standard blow-out mode and the zoning mode. The heating operation and the cooling operation includes: supplying conditioned air to the indoor space (500) by the operations of both of the compressor and the indoor fan (31); and temporarily suspending the compressor, with the indoor fan (31) kept running (i.e., a circulation operation).

Other Configurations

Although not shown, the indoor unit (10) includes a suction temperature sensor and a heat exchanger temperature sensor in addition to the above-described elements. The suction temperature sensor detects a temperature of air sucked from the inlet (23). The heat exchanger temperature sensor detects a temperature of the indoor heat exchanger (32).

<Airflow in Indoor Unit>

The indoor fan (31) rotates during the operation of the indoor unit (10). The rotating indoor fan (31) allows the indoor air in the indoor space (500) to pass through the inlet (23) and flow in the primary space (21*c*) in the casing (20). The air which has flowed in the primary space (21*c*) is drawn by the indoor fan (31) and expelled into the secondary space (21*d*).

The air which has flowed into the secondary space (21*d*) is cooled or heated while passing through the indoor heat exchanger (32), and then flows separately into the four main blow-out paths (34*a* to 34*d*) and the four auxiliary blow-out paths (35*a* to 35*d*). The air which has flowed into the main blow-out paths (34*a* to 34*d*) is supplied to the indoor space (500) through the main blow-out openings (24*a* to 24*d*). The air which has flowed into the auxiliary blow-out paths (35*a* to 35*d*) is supplied to the indoor space (500) through the auxiliary blow-out openings (25*a* to 25*d*).

That is, the indoor fan (31) generates the flow of air coming into the casing body (21) from the indoor space (500) through the inlet (23) and supplied back into the indoor space (500) through the blow-out opening (26).

In the indoor unit (10) performing a cooling operation, the indoor heat exchanger (32) serves as an evaporator of the refrigerant, so that the air before supplied into the indoor space (500) is cooled by the refrigerant while the air passes through the indoor heat exchanger (32). In the indoor unit (10) performing a heating operation, the indoor heat exchanger (32) serves as an radiator of the refrigerant, so that the air before supplied into the indoor space (500) is heated by the refrigerant while the air passes through the indoor heat exchanger (32).

<Position to be Held by Airflow Direction Adjusting Flap>

Positions to be held by each of the airflow direction adjusting flaps (51) will be described below.

As mentioned above, the airflow direction adjusting flap (51) changes the direction of blown air by rotating about the central shaft (53). The airflow direction adjusting flap (51) is movable between a horizontal airflow position illustrated in FIG. 7 and a downward airflow position illustrated in FIG. 8. The airflow direction adjusting flap (51) may further rotate from the downward airflow position illustrated in FIG. 8 and move to an airflow blocking position illustrated in FIG. 9.

Figure 7:
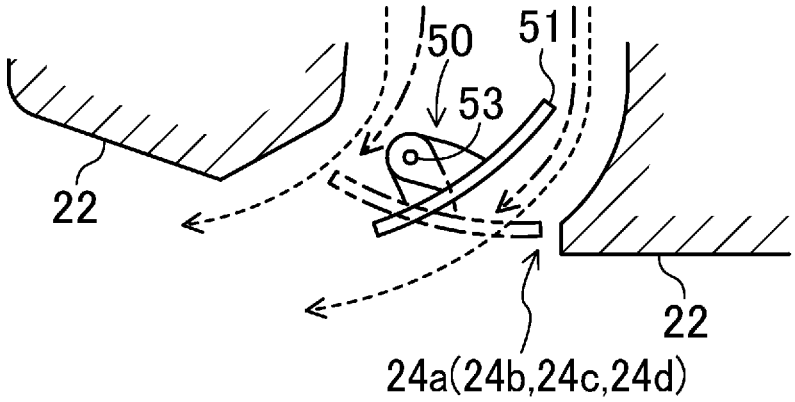
FIG. 7 is a diagram illustrating a cross-sectional view of a main part of a decorative panel, showing an airflow direction adjusting flap in a horizontal airflow position.

When the airflow direction adjusting flap (51) is in the horizontal airflow position illustrated in FIG. 7, the downward direction of the air coming from the main blow-out path (34*a* to 34*d*) is changed to a lateral direction, and the blown air coming from the main blow-out opening (24*a* to 24*d*) is horizontal. In this case, the direction of blown air through the main blow-out opening (24*a* to 24*d*) (that is, the direction of air coming from the main blow-out opening (24*a* to 24*d*)) is set to be, for example, about 25° from the horizontal direction. That is, strictly saying, the direction of blown air is angled slightly downward from the horizontal direction, but substantially the same as the horizontal direction. The horizontally blown air allows the air coming from the main blow-out opening (24*a* to 24*d*) to reach the wall of the indoor space (500).

The horizontally blown air is not limited to the airflow about 25° downward with respect to the horizontal direction.

Figure 8:
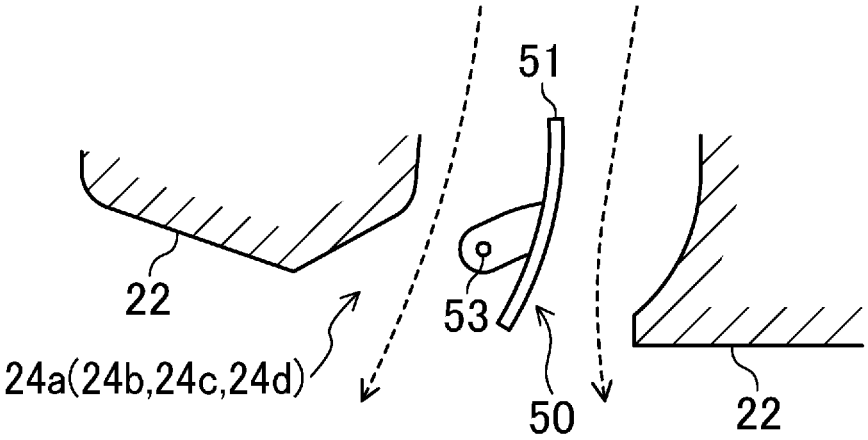
FIG. 8 is a diagram illustrating a cross-sectional view of the main part of the decorative panel, showing the airflow direction adjusting flap in a downward airflow position.

When the airflow direction adjusting flap (51) is in the downward airflow position illustrated in FIG. 8, the downward direction of the air coming from the main blow-out path (34*a* to 34*d*) is maintained substantially as it is, and the blown air coming from the main blow-out opening (24*a* to 24*d*) is directed downward. In this case, strictly saying, the direction of the blown air is slightly angled from the vertical direction, that is, obliquely downward, away from the inlet (23).

Figure 9:
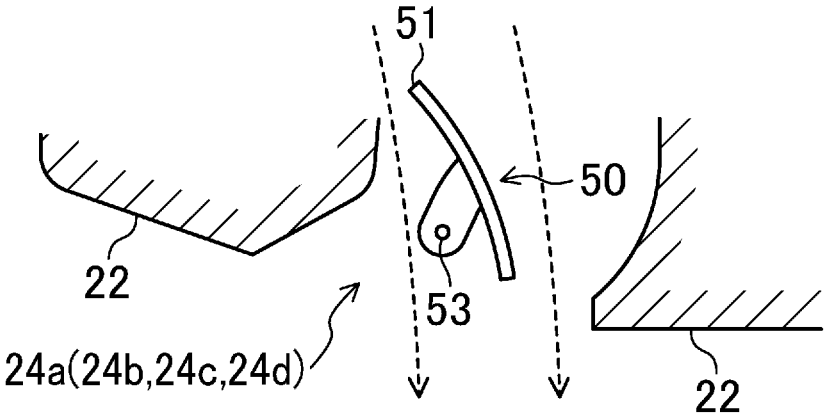
FIG. 9 is a diagram illustrating a cross-sectional view of the main part of the decorative panel, showing the airflow direction adjusting flap in an airflow blocking position.

When the airflow direction adjusting flap (51) is in the airflow blocking position illustrated in FIG. 9, a large portion of the main blow-out opening (24*a* to 24*d*) is closed by the airflow direction adjusting flap (51), and the downward direction of the air coming from the main blow-out path (34*a* to 34*d*) is changed toward the inlet (23). In the airflow blocking position, the air is supplied toward the inlet (23) from the main blow-out opening (24*a* to 24*d*). Thus, the air coming from the main blow-out opening (24*a* to 24*d*) is immediately sucked in the inlet (23). That is, substantially no air is supplied to the indoor space (500) through the main blow-out opening (24*a* to 24*d*) where the airflow direction adjusting flap (51) is taking the airflow blocking position.

<Airflow Rotation Operation in Zoning Mode>

In the airflow rotation operation in the zoning mode, the indoor unit (10) performs a full blow-out operation only for a predetermined time period (e.g., two minutes) from the start of the airflow rotation. After that, the indoor unit (10) changes the main blow-out openings (24*a* to 24*d*) through which the air is blown, in coordination with a first partial blow-out operation and a second partial blow-out operation alternately performed by the indoor unit (10). For convenience of explanation, the rotational speed of the indoor fan (31) in the airflow rotation operation according to the first embodiment is assumed to remain substantially at a maximum value.

An airflow rotation operation in the zoning mode will be described below with reference to FIG. 10.

In the full blow-out operation, the CPU (92) sets the airflow direction adjusting flaps (51) at all the main blow-out openings (24*a* to 24*d*) to a position other than the airflow blocking position. In other words, in the full blow-out operation, air is supplied from the four main blow-out openings (24*a* to 24*d*) into the indoor space (500).

In the first partial blow-out operation, the CPU (92) sets each of the airflow direction adjusting flaps (51) at the main blow-out openings (24*a*, 24*b*) adjacent to each other via the auxiliary blow-out opening (25*a*) to a position other than the airflow blocking position, and sets each of the airflow direction adjusting flaps (51) at the main blow-out openings (24*c*, 24*d*) adjacent to each other via the auxiliary blow-out opening (25*c*) to the airflow blocking position.

In the second partial blow-out operation, the CPU (92) sets each of the airflow direction adjusting flaps (51) at the main blow-out openings (24*b*, 24*c*) adjacent to each other via the auxiliary blow-out opening (25*b*) to a position other than the airflow blocking position, and sets each of the airflow direction adjusting flaps (51) at the main blow-out openings (24*d*, 24*a*) adjacent to each other via the auxiliary blow-out opening (25*d*) to the airflow blocking position.

Airflow Rotation During Heating Operation

More specifically, in the full blow-out operation during heating operation, the CPU (92) sets the airflow direction adjusting flaps (51) at all the main blow-out openings (24*a* to 24*d*) to the downward airflow position. Thus, warm air is blown downward from all the main blow-out openings (24*a* to 24*d*).

In the first partial blow-out operation, the CPU (92) sets each of the airflow direction adjusting flaps (51) at the main blow-out openings (24*a*, 24*b*) to the horizontal airflow position. Thus, warm air is blown substantially horizontally from the main blow-out openings (24*a*, 24*b*), but substantially no air is blown from the main blow-out openings (24*c*, 24*d*).

In the second partial blow-out operation, the CPU (92) sets each of the airflow direction adjusting flaps (51) at the main blow-out openings (24*b*, 24*c*) to the horizontal airflow position. Thus, warm air is blown substantially horizontally from the main blow-out openings (24*b*, 24*c*), but substantially no air is blown from the main blow-out openings (24*d*, 24*a*).

During the airflow rotation in the heating operation, the warm air is always blown from the auxiliary blow-out openings (25*a* to 25*d*).

Duration of each of the full blow-out operation, the first partial blow-out operation, and the second partial blow-out operation is set to, but not limited to, an equal time period (e.g., 120 seconds) in the first embodiment.

Airflow Rotation During Cooling Operation

More specifically, in the full blow-out operation during the cooling operation, the CPU (92) causes the airflow direction adjusting flaps (51) at all the main blow-out openings (24*a* to 24*d*) to take the horizontal airflow position and the downward airflow position alternately. Thus, cold air is blown from the four main blow-out openings (24*a* to 24*d*) toward the indoor space (500), and the direction of the blown air varies.

The first partial blow-out operation during the cooling operation is similar to the first partial blow-out operation during the above-described heating operation, and the second partial blow-out operation during the cooling operation is similar to the second partial blow-out operation during the above-described heating operation, except that the temperature of the blown air differs between the cooling operation and the heating operation.

During the airflow rotation in the cooling operation, the cool air is always blown from the auxiliary blow-out openings (25*a* to 25*d*).

Duration of each of the full blow-out operation, the first partial blow-out operation, and the second partial blow-out operation is set to, but not limited to, an equal time period (e.g., 120 seconds) in the first embodiment.

<Integrated Volume of Air for Each Area in Airflow Rotation Operation>

The airflow rotation operation, whether performed during the heating operation or the cooling operation, is intended to cause the integrated volume of air blown from the same single indoor unit (10) and reaching the area (500A) and the area (500B) to differ between the areas. In other words, in the airflow rotation operation according to the first embodiment, the amount of heat to be processed for each area (500A, 500B) is adjusted by causing the integrated volume of blown air supplied to each area (500A, 500B) per predetermined time period to differ between the areas (500A, 500B).

The integrated volume of air in an airflow rotation operation will be described in detail with reference to FIGS. 11 and 12.

Figure 11:
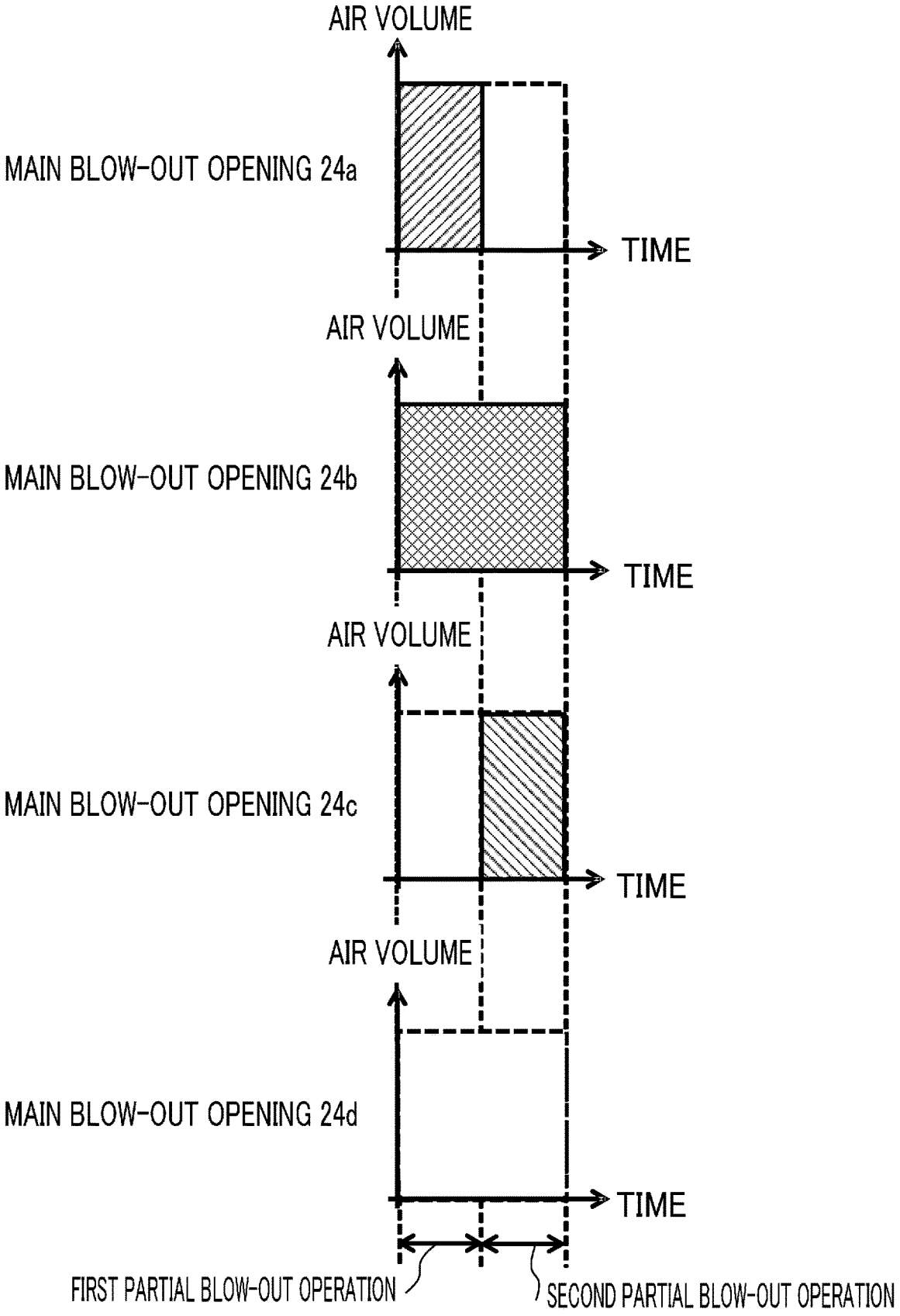
FIG. 11 is a graph showing an integrated value of the volume of air blown from each blow-out opening in the airflow rotation operation in FIG. 10.

FIG. 11 shows a chronological change in the volume of air blown from each of the main blow-out openings (24*a* to 24*c*) in a predetermined time period, in a case in which the first partial blow-out operation and the second partial blow-out operation are sequentially performed once (one cycle).

As mentioned earlier, the cycle shown in FIG. 11 is carried out on condition that the rotational speed of the indoor fan (31) is maximum and constant and that the duration of the first partial blow-out operation and the duration of the second partial blow-out operation are equal to each other. Based on the above conditions and the airflow rotation operation, it can be said, as shown in FIG. 11, that the integrated volume of air blown from the main blow-out opening (24*a*) during the first partial blow-out operation and the integrated volume of air blown from the main blow-out opening (24*c*) during the second partial blow-out operation are equal to each other. Throughout the first partial blow-out operation and the second partial blow-out operation, a constant volume of air is continuously blown from the main blow-out opening (24*b*) for the predetermined time period, whereas no air is blown for the predetermined time period from the main blow-out opening (24*d*) which continues to take the airflow blocking position for the predetermined time period.

It can thus be said that the integrated volume of air blown from each of the main blow-out openings (24*a*, 24*c*) per predetermined time period is about half the integrated volume of air blown from the main blow-out opening (24*b*) per predetermined time period, and that the integrated volume of air blown from the main blow-out opening (24*d*) per predetermined time is zero.

Now, the integrated volume of air blown from each main blow-out opening (24*a* to 24*d*) shown in FIG. 11 will be discussed in terms of a positional relationship between the main blow-out openings (24*a* to 24*d*) and each area (500A, 500B) shown in FIG. 2.

The main blow-out openings (24*a*, 24*c*) are positioned across the areas (500A, 500B). Thus, half of the integrated volume of air blown from the main blow-out opening (24*a*, 24*c*) is supplied to each of the area (500A) and the area (500B). All of the integrated volume of air blown from the main blow-out opening (24*b*) is supplied to the area (500B).

Specifically, air is blown from the main blow-out opening (24*a*) in only the first partial blow-out operation, and the airflow direction adjusting flap at the main blow-out opening (24*a*) takes the airflow blocking position in the second partial blow-out operation. Air is blown from the main blow-out opening (24*c*) in only the second partial blow-out operation, and the airflow direction adjusting flap at the main blow-out opening (24*c*) takes the airflow blocking position in the first partial blow-out operation. This means that, when the integrated volume of air supplied from the main blow-out opening (24*b*) to the area (500B) is regarded as 100%, 25% of the integrated volume of air is supplied from the main blow-out opening (24*a*) to each of the areas (500A, 500B) during the first partial blow-out operation, and 25% of the integrated volume of air is supplied from the main blow-out opening (24*c*) to each of the areas (500A, 500B) during the second partial blow-out operation.

Note that the breakdown of the integrated volume of air supplied from the main blow-out opening (24*c*) to the area (500B) in the respective partial blow-out operations is 50% during the first partial blow-out operation and 50% during the second partial blow-out operation.

Figure 12:
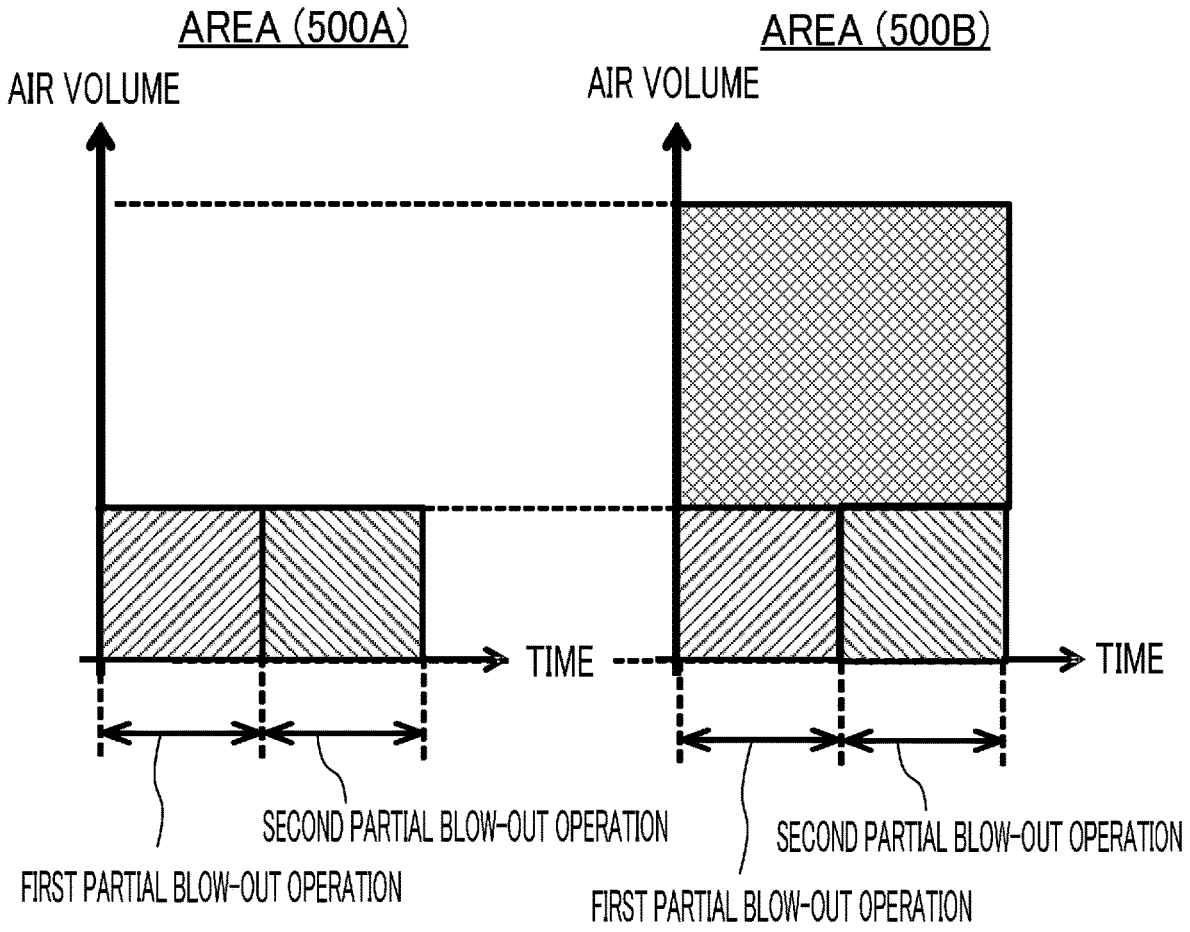
FIG. 12 is a graph showing an integrated value of the volume of air which has reached each area in the airflow rotation operation in FIG. 10.

Consequently, as shown in FIG. 12, the total sum of the integrated volume of air supplied to the area (500A) per predetermined time period is the sum of the integrated volume of air from the main blow-out opening (24*a*), that is 25%, and the integrated volume of air from the main blow-out opening (24*c*), that is 25%. The total sum is therefore 50%. The total sum of the integrated volume of air supplied to the area (500B) per predetermined time period is the sum of the integrated volume of air from the main blow-out opening (24*a*), that is 25%, the integrated volume of air from the main blow-out opening (24*b*), that is 100%, and the integrated volume of air from the main blow-out opening (24*c*), that is 25%. The total sum is therefore 150%. Hence, more conditioned air is supplied to the area (500B) than to the area (500A). The area (500B) is more intensively cooled or warmed than the area (500A).

In other words, a two-way blow is repeated in the airflow rotation operation shown in FIG. 11. In the two-way blow, a larger volume of air is supplied to the area (500B), which is a high-priority area where the temperature therein should be adjusted intensively, than to the area (500A), which is a low-priority area where the temperature therein does not have to be adjusted as intensively as that in the high-priority area. The two-way blow is achieved by adjusting the length of time in which the airflow direction adjusting flap (51) takes the airflow blocking position, for each of the main blow-out openings (24*a* to 24*d*). The adjustment of said length of time can achieve different integrated volume of air per predetermined time period for each of the areas (500A, 500B) as shown in FIG. 12.

In achieving the different integrated volume of air to be supplied to each area (500A, 500B), the length of time in which the airflow direction adjusting flap (51) takes the airflow blocking position may be further adjusted, so that the period of time in which the air is supplied to the low-priority area (500A) be shorter than the period of time in which the air is supplied to the high-priority area (500B).

As another way of achieving the different integrated volume of air to be supplied to each area (500A, 500B), the rotational speed of the indoor fan (31) may be adjusted so as not to be constant, so that air having a lower speed than air to be supplied to the high-priority area (500B) be supplied to the low-priority area (500A). Alternatively, the further adjustment of the length of time in which the airflow direction adjusting flap (51) takes the airflow blocking position may be made together with the adjustment of the rotational speed of the indoor fan (31).

Target values of the integrated volume of air blown from each of the main blow-out openings (24*a* to 24*d*) shown in FIG. 11 and target values of the integrated volume of air supplied to each of the areas (500A, 500B) shown in FIG. 12 may be determined based on a target temperature of each of the areas (500A, 500B).

However, an actual temperature of each area (500A, 500B) might not reach the target temperature due to an actual environment (such as temperature and humidity) of each area (500A, 500B) even when the airflow rotation operation is performed according to the determined target value of the integrated volume of air. In view of this, in a preferred embodiment, the CPU (92) may finely adjust the position to be held by the airflow direction adjusting flap (51), the time spent in that position, and the rotational speed of the indoor fan (31) in the airflow rotation operation, according to the difference between the detection results of the temperature sensors (81*a*, 81*b*) and the target temperatures of the areas (500A, 500B).

<Advantages>

In the first embodiment, air blown from a single indoor unit (10) is supplied to each of the areas (500A, 500B) of the indoor space (500). In particular, the amount of heat to be processed by the blown air for each of the areas (500A, 500B) is adjusted so that the temperatures of the respective areas (500A, 500B) differ from each other. Specifically, the amount of heat to be processed for each area (500A, 500B) is adjusted by adjusting the period of time in which each airflow direction adjusting flap (51) guides the blown air in a predetermined direction (particularly a length of time in which each airflow direction adjusting flap (51) takes the airflow blocking position) so that the integrated volume of air reaching the respective areas (500A, 500B) per predetermined time period may differ between the areas (500A, 500B). This configuration makes it possible to easily and reliably create, with even a single indoor unit (10), a plurality of areas (500A, 500B) having different temperatures in a single indoor space (500) after the lapse of a predetermined time period.

In the first embodiment, each of the areas (500A, 500B) is provided with one temperature sensor (81*a*, 81*b*), and the amount of heat to be processed for each area (500A, 500B) is further adjusted based on the temperature of the area (500A, 500B) detected by the temperature sensor (81*a*, 81*b*). The area (500A, 500B) therefore has a temperature different from the temperature of the other area with more reliability.

The airflow direction adjusting flap (51) can take the airflow blocking position, where the airflow blown from the blow-out opening (24*a* to 24*d*) is blocked. Hence, the airflow direction adjusting flap (51) also serves as an airflow inhibition mechanism (50). Such features allow each area (500A, 500B) to have a different temperature without another airflow inhibition mechanism (50) in addition to the airflow direction adjusting flap (51).

Additional adjustment of the rotational speed of the indoor fan (31) may contribute to further adjusting the amount of airflow reaching the areas (500A, 500B), so that the respective areas (500A, 500B) reliably have different temperatures at least after the lapse of a predetermined time period.

Second Embodiment

A second embodiment is different from the first embodiment in a specific means for adjusting the amount of heat to be processed for each area (500A, 500B).

Note that the second embodiment is similar to the first embodiment in the configuration of the indoor unit (10), the flow of air in the indoor unit (10), and the position to be held by the airflow direction adjusting flap (51).

<Airflow Rotation Operation in Zoning Mode>

Figure 13:
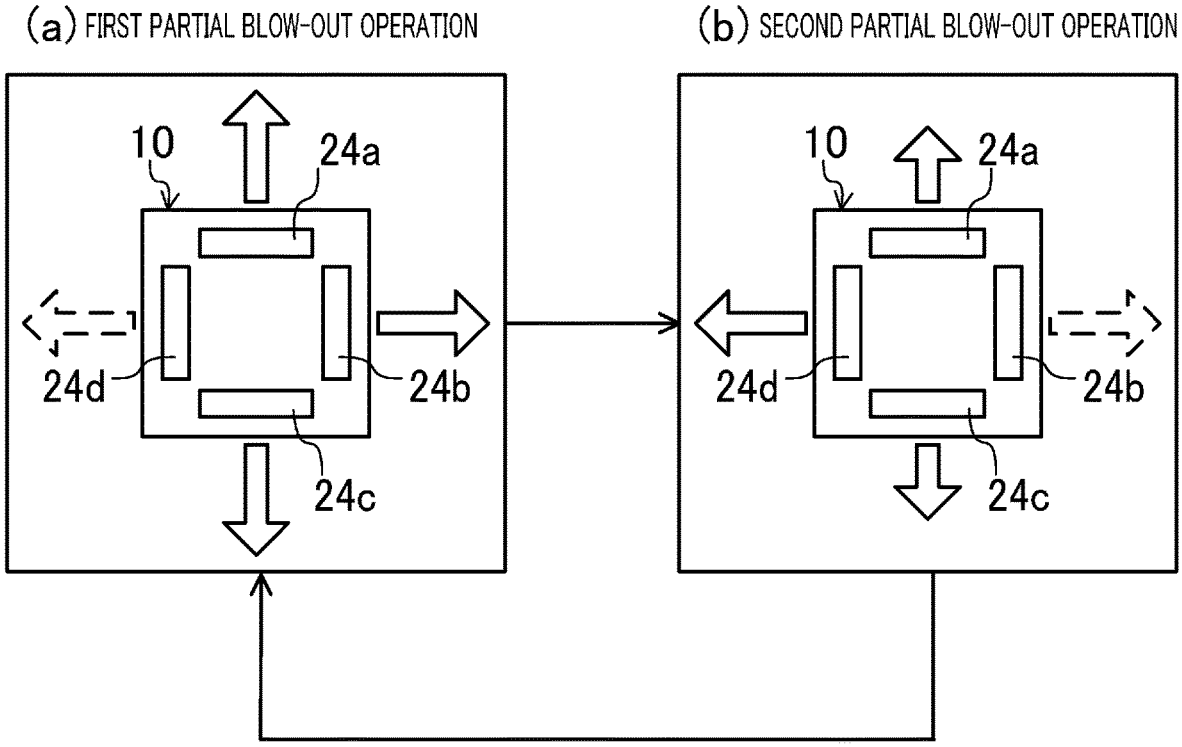
FIG. 13 is a diagram for explaining one cycle of an airflow rotation operation according to a second embodiment, and schematically illustrates a bottom surface of the indoor unit making each movement.

An airflow rotation operation according to the second embodiment will be described below with reference to FIG. 13. The airflow rotation operation illustrated in FIG. 13 is performed when the zoning mode is selected. Similarly to the first embodiment, the full blow-out operation is performed at the start of the airflow rotation operation, and thereafter the first partial blow-out operation and the second partial blow-out operation illustrated in FIG. 13 are alternately performed.

In the first partial blow-out operation, the CPU (92) sets each of the airflow direction adjusting flaps (51) at the main blow-out openings (24*a*, 24*b*, 24*c*) adjacent to each other via the auxiliary blow-out openings (25*a*, 25*b*) to a position other than the airflow blocking position, and sets the airflow direction adjusting flap (51) at the main blow-out opening (24*d*) to the airflow blocking position.

In the second partial blow-out operation, the CPU (92) sets each of the airflow direction adjusting flaps (51) at the main blow-out openings (24*c*, 24*d*, 24*a*) adjacent to each other via the auxiliary blow-out opening (25*c*, 25*d*) to a position other than the airflow blocking position, and sets the airflow direction adjusting flap (51) at the main blow-out opening (24*b*) to the airflow blocking position.

Airflow Rotation During Heating Operation

More specifically, in the first partial blow-out operation during a heating operation, the CPU (92) sets each of the airflow direction adjusting flaps (51) at the main blow-out openings (24*a*, 24*b*, 24*c*) to the horizontal airflow position. Thus, warm air is blown substantially horizontally from the main blow-out openings (24*a*, 24*b*, 24*c*), but substantially no air is blown from the main blow-out opening (24*d*).

In the second partial blow-out operation, the CPU (92) sets each of the airflow direction adjusting flaps (51) at the main blow-out openings (24*c*, 24*d*, 24*a*) to the horizontal airflow position. Thus, warm air is blown substantially horizontally from the main blow-out openings (24*c*, 24*d*, 24*a*), but substantially no air is blown from the main blow-out opening (24*b*).

During the airflow rotation in the heating operation, the warm air is always blown from the auxiliary blow-out openings (25*a* to 25*d*).

Duration of each of the first partial blow-out operation and the second partial blow-out operation is set to, but not limited to, an equal time period (e.g., 120 seconds) in the present embodiment.

Airflow Rotation During Cooling Operation

The details of the first partial blow-out operation and the second partial blow-out operation during a cooling operation are the same as those in the heating operation, except that the temperature of blown air differs between the cooling and heating operations.

During the airflow rotation in the cooling operation, the cool air is always blown from the auxiliary blow-out openings (25*a* to 25*d*).

Duration of each of the first partial blow-out operation and the second partial blow-out operation is set to, but not limited to, an equal time period (e.g., 120 seconds) in the present embodiment.

(Control of Refrigerant Temperature by Airflow Rotation Operation)

Figure 14:
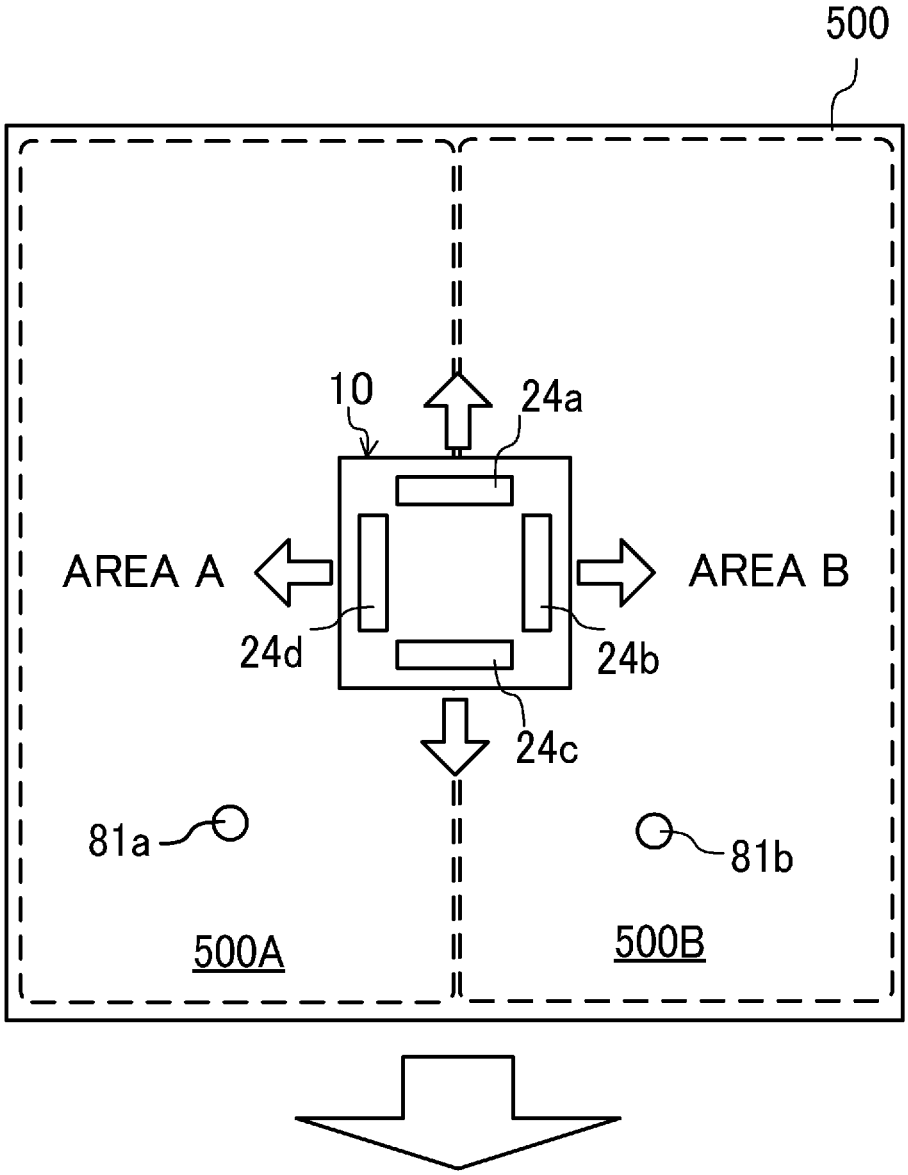
FIG. 14 is a diagram for explaining a case in which each area has a different target value for an evaporation temperature and a different target value for a condensation temperature in the second embodiment.

The airflow rotation operation alternately performs a pattern in which a greater volume of air is supplied to the area (500B) than that to the area (500A) and a pattern in which a greater volume of air is supplied to the area (500A) than to the area (500B). The airflow rotation operation of FIG. 13 in view of FIG. 14 shows that air is supplied mainly to the area (500B) in the first partial blow-out operation, and that air is supplied mainly to the area (500A) in the second partial blow-out operation.

The CPU (92) of the second embodiment adjusts, in the airflow rotation operation, the amount of heat to be processed for each area (500A, 500B) by changing under control the temperature of the refrigerant, depending on which area (500A, 500B) the air is to be mainly supplied, that is, depending on the type of the partial blow-out operation.

Specifically, in a cooling operation in which the indoor heat exchanger (32) functions as an evaporator of the refrigerant, the CPU (92) causes evaporation temperatures of the refrigerant in the indoor heat exchanger (32) to differ between the areas (500A, 500B) as a main destination of the blown air, thereby adjusting the amount of heat to be processed for each area (500A, 500B). Particularly, as shown in FIG. 14, the evaporation temperature of the refrigerant in the first partial blow-out operation in which the main blow-out destination is the area (500B) (i.e., the high-priority area) is adjusted to be lower than the evaporation temperature of the refrigerant in the second partial blow-out operation in which the main blow-out destination is the area (500A) (i.e., the low-priority area). In this case, the CPU (92) may set different target values of the evaporation temperatures for the areas (500A, 500B) so that the above-described adjustment be reliably implemented.

That is, in the cooling operation, the cooling capacity of the indoor unit (10) increases and the air blown from each of the main blow-out openings (24*a*, 24*b*, 24*c*) is further cooled in the first partial blow-out operation in which the main blow-out destination is the area (500B). On the other hand, in the second partial blow-out operation in which the main blow-out destination is the area (500A), the cooling capacity of the indoor unit (10) decreases and the air blown from each of the main blow-out openings (24*a*, 24*b*, 24*c*) is not as cool as in the first partial blow-out operation.

In a heating operation in which the indoor heat exchanger (32) functions as a radiator of the refrigerant, the CPU (92) causes condensation temperatures of the refrigerant in the indoor heat exchanger (32) to differ between the areas (500A, 500B) as a main destination of the blown air, thereby adjusting the amount of heat to be processed for each area (500A, 500B). Particularly, as shown in FIG. 14, the condensation temperature of the refrigerant in the first partial blow-out operation in which the main blow-out destination is the area (500B) is adjusted to be higher than the condensation temperature of the refrigerant in the second partial blow-out operation in which the main blow-out destination is the area (500A). In this case, the CPU (92) may set different target values of the condensation temperatures for the areas (500A, 500B) so that the above-described adjustment be reliably implemented.

That is, in the heating operation, the heating capacity of the indoor unit (10) increases and the air blown from each of the main blow-out openings (24*a*, 24*b*, 24*c*) is further warmed in the first partial blow-out operation in which the main blow-out destination is the area (500B). On the other hand, in the second partial blow-out operation in which the main blow-out destination is the area (500A), the heating capacity of the indoor unit (10) decreases and the air blown from each of the main blow-out openings (24*a*, 24*b*, 24*c*) is not as warm as in the first partial blow-out operation.

Note that air is always blown from the main blow-out openings (24*a*, 24*c*) provided across the areas (500A, 500B). Thus, air that has been further cooled (or further heated) and air not much cooled (or not much heated) are alternately blown from the main blow-out openings (24*a*, 24*b*). Thus, the air that has been further cooled (or further heated) and the air not much cooled (or not much heated) are alternately supplied to the areas (500A, 500B) from the main blow-out openings (24*a*, 24*c*). However, the breakdown of the integrated volume of air supplied to each of the areas (500A, 500B) per predetermined time period is as follows: with respect to the area (500B), the integrated volume of the air that has been further cooled (or further heated) is larger than the integrated volume of the air not much cooled (or not much heated); and with respect to the area (500A), the integrated volume of the air not much cooled (or not much heated) is larger than the integrated volume of the air that has been further cooled (or further heated). This configuration can cause the amounts of heat to be processed for each of the area (500B) (i.e., a high-priority area) and the area (500A) (i.e., a low-priority area) to differ from each other, and thereby makes it possible to cause the temperatures in the areas (500A, 500B) to differ between the areas, even when both of the air that has been further cooled (or further heated) and the air not much cooled (or not much heated) are supplied to one area (500A, 500B).

<Advantages>

In the second embodiment, air blown from a single indoor unit (10) is supplied to each of the areas (500A, 500B) of the indoor space (500). In particular, the amount of heat to be processed by the blown air for each of the areas (500A, 500B) is adjusted so that the temperatures of the respective areas (500A, 500B) differ from each other. Specifically, the amount of heat to be processed for each of the areas (500A, 500B) is adjusted by causing the temperatures of the air itself blown into the respective areas (500A, 500B) to differ from each other. This configuration makes it possible to easily create, with even a single indoor unit (10), a plurality of areas (500A, 500B) having different temperatures in a single indoor space (500).

In particular, the second embodiment carries out control to cause the evaporation temperatures (or the condensation temperatures) of the refrigerant in the indoor heat exchanger (32) to differ between the areas (500A, 500B) to be the main supply destinations of the air. The above-disclosed control achieves a more distinct difference in temperatures of the air that has reached the respective areas (500A, 500B), which reliably creates a situation in which the temperatures of the respective areas (500A, 500B) are different from each other.

In the above control, different target values of the evaporation temperatures (or the condensation temperatures) are set for the areas (500A, 500B), so that the difference in the temperatures of air that has reached the respective areas (500A, 500B) are more distinct.

Similarly to the first embodiment, the amount of heat to be processed for each area (500A, 500B) is further adjusted based on the temperature of the area (500A, 500B) detected by the temperature sensor (81*a*, 81*b*) in the second embodiment, as well. The area (500A, 500B) therefore has a temperature different from the temperature of the other area with more reliability.

<<Variations>>

First Variation

In a case in which the indoor space (500) is divided into three or more areas, the amount of heat to be processed may be adjusted for each area so that the temperatures in at least two of the three or more areas may be different from each other.

Second Variation

It is not essential to carry out control in order to further adjust the amounts of heat to be processed for the areas (500A, 500B) based on the temperature sensors (81*a*, 81*b*).

Not all the areas, but at least one of the areas may be a target area of the above control using the temperature sensors.

The temperature sensors may be provided at the decorative panel (22) of the indoor unit (10). In this case, the temperature sensors may be capable of detecting a temperature of at least one area as a preferred embodiment.

Third Variation

In the second embodiment, further control may be carried out to cause the integrated volumes of air according to the first embodiment to differ between the areas (500A, 500B).

Fourth Variation

In the first embodiment, the integrated volume of air per predetermined time period may be set to differ between the areas (500A, 500B) by adjusting the rotational speed of the indoor fan (31), without adjusting the length of the time in which the airflow direction adjusting flap (51) takes the airflow blocking position.

Fifth Variation

Figure 10:
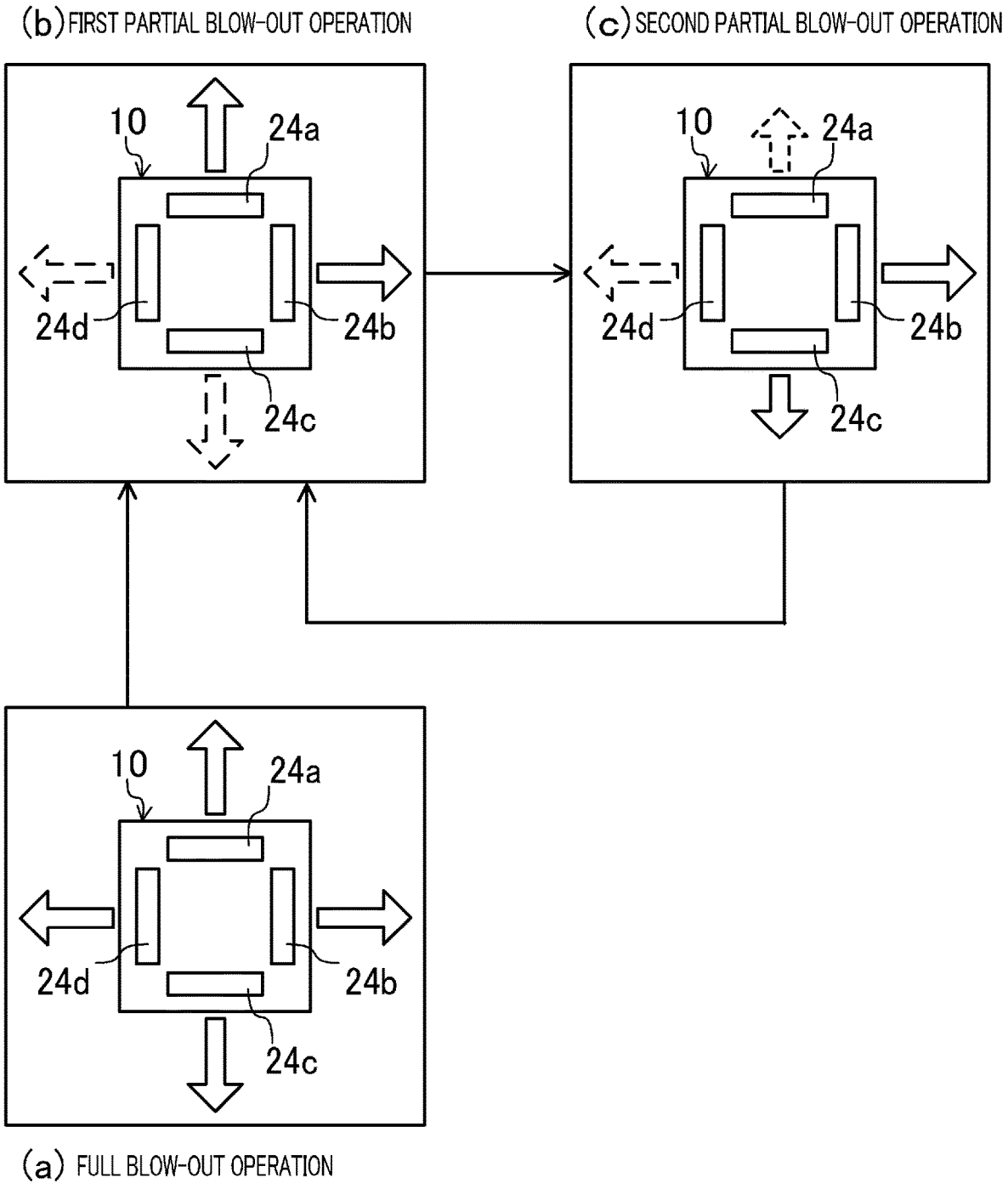
FIG. 10 is a diagram for explaining one cycle of an airflow rotation operation according to the first embodiment, and schematically illustrates a bottom surface of the indoor unit making each movement.

The airflow rotation operation is not limited to the airflow rotation operations illustrated in FIGS. 10 and 13.

Sixth Variation

The standard blow-out mode or the zoning mode may be set manually or automatically.

Seventh Variation

The angle of the airflow direction adjusting flaps (51) in the horizontal airflow position with respect to the horizontal direction may be finely adjusted as necessary, according to the distance from the location of the indoor unit (10) to the wall surface of the indoor space (500), so that the air blown from the main blow-out openings (24*a* to 24*d*) can reliably reach the vicinity of the wall of the indoor space (500). The distance from the location of the indoor unit (10) to the wall surface of the indoor space (500) may be input to the indoor control unit (90) at the installation of the indoor unit (10) in the indoor space (500) by a worker who installs the indoor unit (10). Alternatively, a sensor for detecting the distance may be attached to the indoor unit (10) in advance.

Eighth Variation

The indoor unit (10) is not limited to the ceiling embedded type. The indoor unit (10) may be of a ceiling suspended type or of a wall hanging type.

In the case of the ceiling embedded type or the ceiling suspended type, the indoor unit (10) does not have to include the auxiliary blow-out openings (25*a* to 25*d*).

Ninth Variation

The number of the main blow-out openings (24*a* to 24*d*) is not limited to four, as long as two or more main blow-out openings are provided.

Tenth Variation

The indoor unit (10) may have a shutter for inhibiting the flow of air blown out of the main blow-out openings (24*a* to 24*d*) as an airflow inhibition mechanism in addition to the airflow direction adjusting flaps (51). In this case, as a preferred embodiment, the airflow inhibition mechanism is provided to correspond to each of the main blow-out openings (24*a* to 24*d*). For example, the airflow inhibition mechanism may be configured as an open/close shutter.

Eleventh Variation

In the first and second partial blow-out operations, the airflow direction adjusting flaps (51) may close the main blow-out openings (24*a* to 24*d*) instead of taking the airflow blocking position. This configuration, in which the main blow-out openings (24*a* to 24*d*) are closed, prevents the air from being blown out of the main blow-out openings (24*a* to 24*d*) more reliably than the configuration in which the airflow direction adjusting flaps (51) take the airflow blocking position, in the first and second blow-out operations.

INDUSTRIAL APPLICABILITY

As can be seen from the foregoing description, the present invention is useful as an indoor unit which causes temperatures of a plurality of areas in one indoor space to differ between the areas with reliability.

DESCRIPTION OF REFERENCE CHARACTERS

10 Indoor Unit
20 Indoor Casing
24*a* to 24*d* Main Blow-Out Opening (Blow-Out Opening)
31 Indoor Fan
32 Indoor Heat Exchanger
50 Airflow Inhibition Mechanism
51 Airflow Direction Adjusting Flap
81*a*, 81*b* Temperature Sensor
91 Memory (Storage Unit)
91*a* Division Information

92 CPU (Adjuster)
500 Indoor Space
500A, 500B Area

The invention claimed is:

1. An indoor unit of an air conditioner, the indoor unit blowing air to an indoor space, the indoor unit comprising:

an indoor casing provided with a first blow-out opening, a second blow-out opening, a third blow-out opening and a fourth blow-out opening;

a non-transitory processor-readable medium having stored thereon division information representing division of the indoor space into a first area and a second area;

an airflow inhibition mechanism comprising at least an airflow direction adjusting flap that inhibits an airflow of air blown out of the first, second, third and fourth blow-out openings; and a processor that controls the airflow inhibition mechanism, wherein the first blow-out opening is positioned across the first area and the second area, the second blow-out opening is positioned to face only the second area, the third blow-out opening is positioned across the first area and the second area, the fourth blow-out opening is positioned to face only the first area, and the processor is configured to control the airflow inhibition mechanism such that the airflow inhibition mechanism alternately performs a first partial blow-out operation to inhibit an airflow only of air blown out of the third blow-out opening and the fourth blow-out opening and a second partial blow-out operation to inhibit an airflow only of the air blown out of the first blow-out opening and the fourth blow-out opening, wherein the control of the airflow inhibition mechanism to alternately perform the first partial blow-out operation and the second blow-out operation causes a temperature of the first area to be different from a temperature in the second area.

2. The indoor unit of claim 1, wherein the at least an airflow direction adjusting flap includes a respective airflow direction adjusting flap for each of the first blow-out opening, the second blow-out opening, the third blow-out opening, and the fourth blow-out opening, and each airflow direction adjusting flap is capable of moving to a position at which the airflow direction adjusting flap inhibits the airflow blown out of the corresponding blow-out opening, and the respective airflow direction adjusting flaps collectively serve as the airflow inhibition mechanism.

3. An indoor unit of an air conditioner, the indoor unit blowing air to an indoor space, the indoor unit comprising:

an indoor casing provided with a first blow-out opening, a second blow-out opening, a third blow-out opening, and a fourth blow-out opening;

an indoor heat exchanger that allows air drawn into the indoor casing to exchange heat with a refrigerant;

a non-transitory processor-readable medium having stored thereon division information representing division of the indoor space into a first area and a second area;

an airflow inhibition mechanism comprising at least an airflow direction adjusting flap that inhibits an airflow of air blown out of the blow-out opening;

a processor that controls the airflow inhibition mechanism, wherein the first blow-out opening is positioned across the first area and the second area, the second blow-out opening is positioned to face only the second area, the third blow-out opening is positioned across the first area and the second area, the fourth blow-out opening is positioned to face only the first area, and the processor is configured to control the airflow inhibition mechanism such that the airflow inhibition mechanism alternately performs a first partial blow-out operation to inhibit an airflow only of air blown out of the fourth blow-out opening and a second partial blow-out operation to inhibit an airflow only of air blown out of the second blow-out opening, in a cooling operation in which the indoor heat exchange functions as an evaporator, the processor is configured to cause an evaporation temperature of the refrigerant in the indoor heat exchanger during the first partial blow-out operation to differ from an evaporation temperature of the refrigerant in the indoor heat exchanger during the second partial air-blow operation, and in a heating operation in which the indoor heat exchanger functions as a radiator, the processor is configured to cause a condensation temperature of the refrigerant in the indoor heat exchanger during the first partial blow-out operation to differ from a condensation temperature of the refrigerant in the indoor heat exchanger during the second partial blow-out operation.

4. The indoor unit of claim 3, wherein the at least an airflow direction adjusting flap includes a respective airflow direction adjusting flap for each of the first blow-out opening, the second blow-out opening, the third blow-out opening, and the fourth blow-out opening, and the airflow direction adjusting flap of each of the blow-out openings is capable of moving to a position at which the airflow direction adjusting flap inhibits the airflow blown out of the blow-out opening of the associated airflow direction adjusting flap, and the respective airflow direction adjusting flaps collectively serve as the airflow inhibition mechanism.

* * * * *